US008571459B2

(12) United States Patent
Moteki

(10) Patent No.: US 8,571,459 B2
(45) **Date of Patent: *Oct. 29, 2013**

(54) IMAGE FORMING APPARATUS WITH FIRST AND SECOND GLOSS MODES

(75) Inventor: Junichi Moteki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/462,143

(22) Filed: May 2, 2012

(65) Prior Publication Data

US 2012/0219336 A1 Aug. 30, 2012

Related U.S. Application Data

(62) Division of application No. 12/508,844, filed on Jul. 24, 2009, now Pat. No. 8,195,077.

(30) Foreign Application Priority Data

Aug. 6, 2008 (JP) ..... 2008-202572

(51) Int. Cl.
*G03G 15/20* (2006.01)

(52) U.S. Cl.
USPC ..... 399/341

(58) Field of Classification Search
USPC ..... 399/82, 341, 342
See application file for complete search history.

(56) References Cited

U.S. PATENT DOCUMENTS

| | | | | |
|---|---|---|---|---|
| 7,395,021 | B2 | 7/2008 | Tamura et al. | |
| 7,783,242 | B2 | 8/2010 | Chigono et al. | |
| 8,195,077 | B2 * | 6/2012 | Moteki | 399/341 |

FOREIGN PATENT DOCUMENTS

| | | | |
|---|---|---|---|
| JP | 04-362679 | A | 12/1992 |
| JP | 09-200551 | A | 7/1997 |
| JP | 2007-332281 | A | 12/2007 |
| JP | 2008-009085 | A | 1/2008 |

* cited by examiner

*Primary Examiner* — William J Royer
(74) *Attorney, Agent, or Firm* — Fitzpatrick, Cella, Harper & Scinto

(57) ABSTRACT

An image forming apparatus includes an image forming portion configured to form and heat-fix a toner image on a recording material; a re-conveying path configured to re-convey the recording material having the toner image on a front side, to the image forming portion to form and heat-fix a toner image on a back side of the recording material; a glossing portion configured to increase glossiness of the toner image; and an executing device configured to execute a high-gloss mode for glossing the toner image on the back side into a high-gloss toner image, and a partial-gloss mode for forming a partial-gloss toner image having glossiness lower than glossiness of the toner image in the high-gloss mode without glossing the toner image on the back side, wherein the glossing portion is provided in the re-conveying path.

7 Claims, 11 Drawing Sheets

IMAGE FORMING APPARATUS WITH FIRST AND SECOND GLOSS MODES

This is a division of U.S. patent application Ser. No. 12/508,844, filed Jul. 24, 2009 now U.S. Pat. No. 8,195,077.

BACKGROUND OF THE INVENTION

1. Field of the Invention

The present invention relates to an image forming apparatus capable of glossing toner images formed on both a front side and a back side of a recording material.

2. Description of the Related Art

The following image forming apparatus is widely used. Specifically, a colored toner image and a transparent toner image are formed on a recording material in an image forming portion using an electrophotographic process, and the toner images are heat-fixed in a fixing portion (Japanese Patent Application Laid-Open No. H09-200551).

As an image forming apparatus for forming a colored toner image, the following image forming apparatus is widely used. In this image forming apparatus, a re-conveying path is provided for re-conveying a recording material having a front side, on which the toner image is fixed, to the image forming portion after reversing the front side and a back side of the recording material. In this manner, the toner image is also formed and fixed on the back side of the recording material.

Further, another image forming apparatus including a glossing portion for performing a glossing process for re-heating a toner image fixed onto a recording material to increase glossiness of the toner image has been put into practical use.

Japanese Patent Application Laid-Open No. H09-200551 describes an image forming apparatus including a transparent image forming portion for forming a transparent toner image and a colored image forming portion for forming a colored toner image, which are arranged along a recording material conveying member (or an intermediate transferring member).

Japanese Patent Application Laid-Open No. H04-362679 describes a glossing portion for heating and pressurizing a recording material bearing an unfixed toner image, which is brought into close contact with an endless fixing belt made of a heat-resistant film. In this glossing portion, after the toner image is forcibly cooled by a cooling portion to be solidified while the recording material remains in close contact with the fixing belt, the recording material, on which the toner image is fixed and solidified, is self-stripped from the fixing belt. An image surface is solidified after a smooth surface profile of the fixing belt. Thus, the smooth image surface excellent in glossiness can be obtained.

Japanese Patent Application Laid-Open No. 2007-332281 describes an image forming apparatus dedicated for transparent images. This image forming apparatus includes a fixing device and an image forming portion for a transparent toner image, and is connected to a later stage outside a housing of a full-color image forming apparatus.

For the glossing process of the toner images on both the front side and the back side of the recording material, it is desirable to provide the re-conveying path for conveying the recording material to the image forming portion after the front side, which has already been subjected to the glossing process in the glossing portion, and the back side of the recording material are reversed to automatically perform the glossing process on both the front side and the back side of the recording material.

However, if the glossing portion is provided downstream of the image forming apparatus, the size of the image forming apparatus is increased in a direction of conveyance of the recording material. Moreover, if the re-conveying path is provided for re-conveying the recording material having the glossed front side to the image forming portion, the size of the image forming apparatus is further increased in the direction of conveyance of the recording material.

SUMMARY OF THE INVENTION

The present invention has been made to prevent an increase in size of an image forming apparatus including a glossing portion and a re-conveying path, which are provided for performing a glossing process on both a front side and a back side of a recording material.

The present invention has been made also to provide the image forming apparatus including:

an image forming portion configured to form a toner image on a recording material and heat-fix the toner image onto the recording material;

a re-conveying path configured to re-convey the recording material having a front side, on which the toner image has been formed and heat-fixed by the image forming portion, to the image forming portion so that a toner image is formed and heat-fixed on a back side of the recording material;

a glossing portion configured to perform a glossing process for increasing glossiness of the toner image formed and heat-fixed by the image forming portion; and an executing device configured to execute:

a high-gloss mode in which the glossing portion performs the glossing process on the toner image formed and heat-fixed on the back side of the recording material re-conveyed through the re-conveying path to the image forming portion so as to form a high-gloss toner image; and a low-gloss mode in which the glossing portion forms, without performing the glossing process on the toner image formed and heat-fixed on the back side of the recording material re-conveyed through the re-conveying path to the image forming portion, a low-gloss toner image having glossiness lower than glossiness of the toner image formed in the high-gloss mode, wherein the glossing portion is provided in the re-conveying path.

Further features of the present invention will become apparent from the following description of exemplary embodiments with reference to the attached drawings.

DESCRIPTION OF THE EMBODIMENTS

Hereinafter, exemplary embodiments of the present invention are described in detail referring to the accompanying drawings. The present invention can be carried out in other embodiments in which a part of or the entire configuration of each of the embodiments is replaced by an alternative configuration as long as a glossing portion is provided in a re-conveying path configured to re-convey a recording material to an image forming portion.

Although only a principal part relating to the formation/transfer of a toner image is described in the embodiments of the present invention, the present invention can be carried out for various uses such as those for a printer, various printing machines, a copying machine, a FAX machine and a multi-function machine with the addition of necessary device, equipment and housing structure.

The present invention is not limited to an embodiment in which only an image forming portion for a transparent toner image is arranged within a housing. The present invention can be also carried out in an embodiment in which image forming portions for toner images of the respective colors including the transparent toner image are provided in the housing.

The illustration and redundant description are herein omitted for general matters of the image forming apparatus and the glossing portion described in Japanese Patent Application Laid-Open Nos. H09-200551, H04-362679, and 2007-332281. The reference symbol with parentheses, which denotes a component recited in the claims, is a mere exemplification for facilitating the understanding of the present invention, and is not intended to limit the component to a corresponding member described in the exemplary embodiments.

(First Embodiment)

Figure 1:
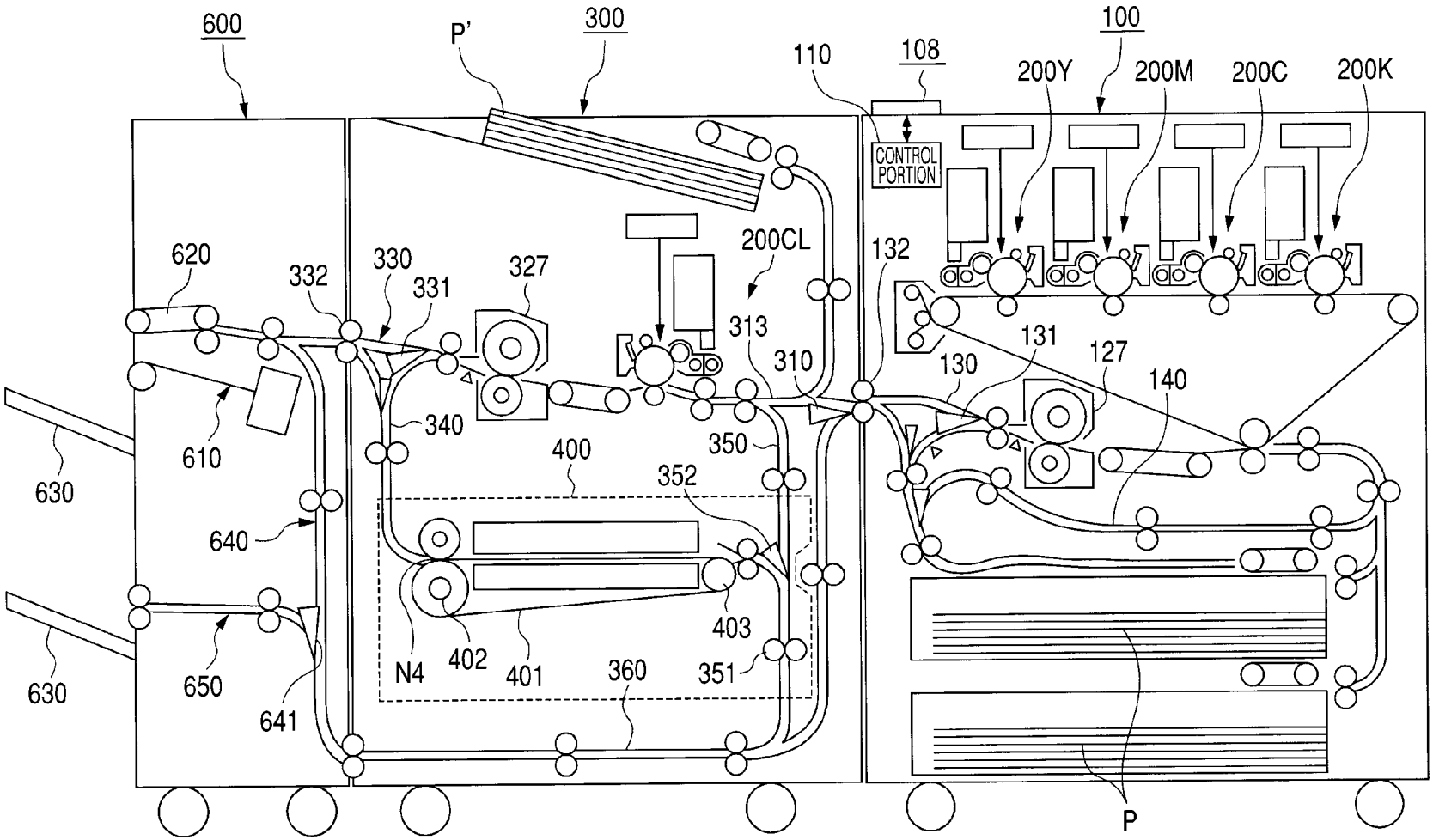
FIG. 1 is an explanatory view illustrating a configuration of an image forming system according to a first embodiment of the present invention.
Figure 2:
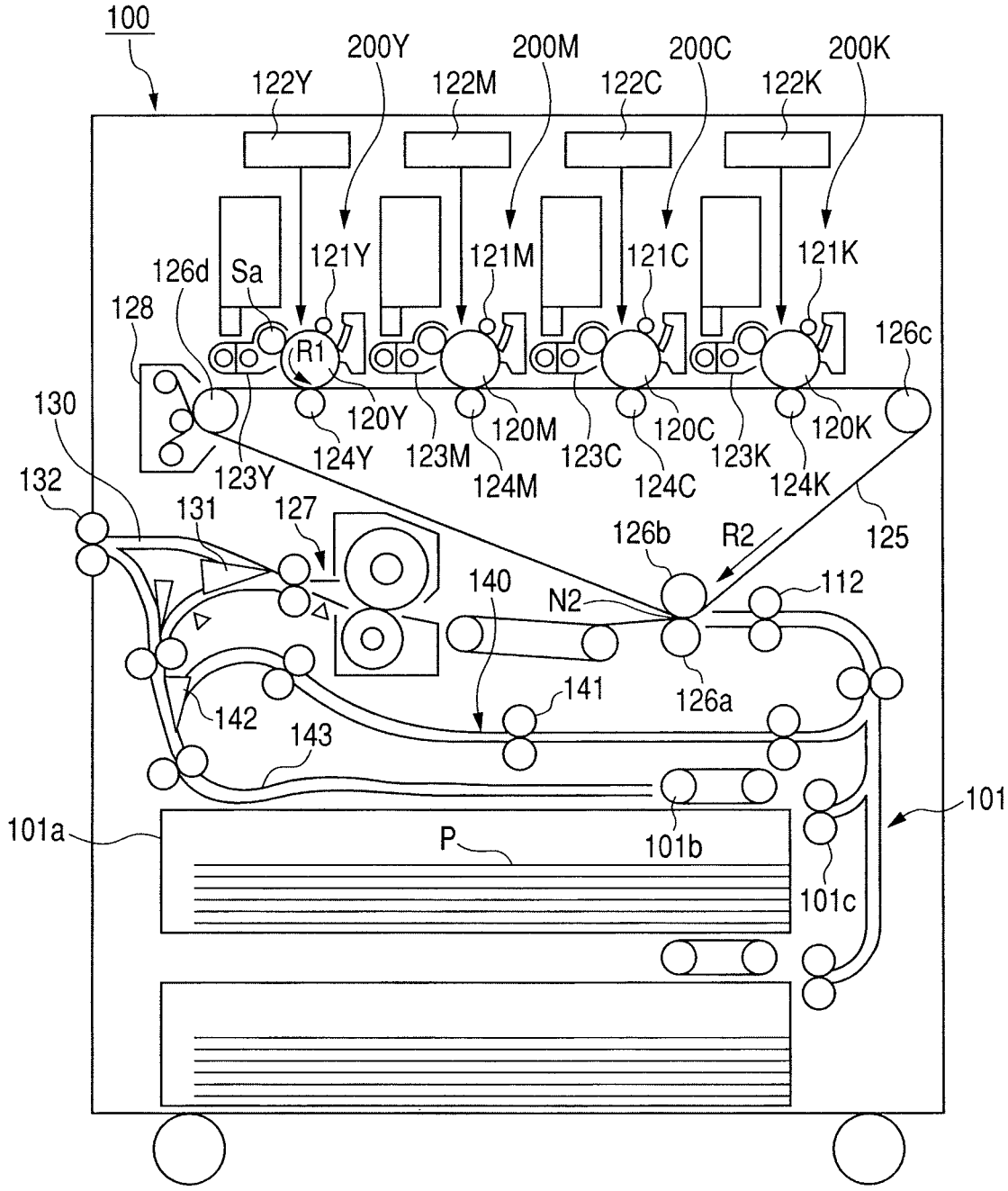
FIG. 2 is an explanatory view illustrating a detailed configuration of an image forming apparatus.
Figure 3:
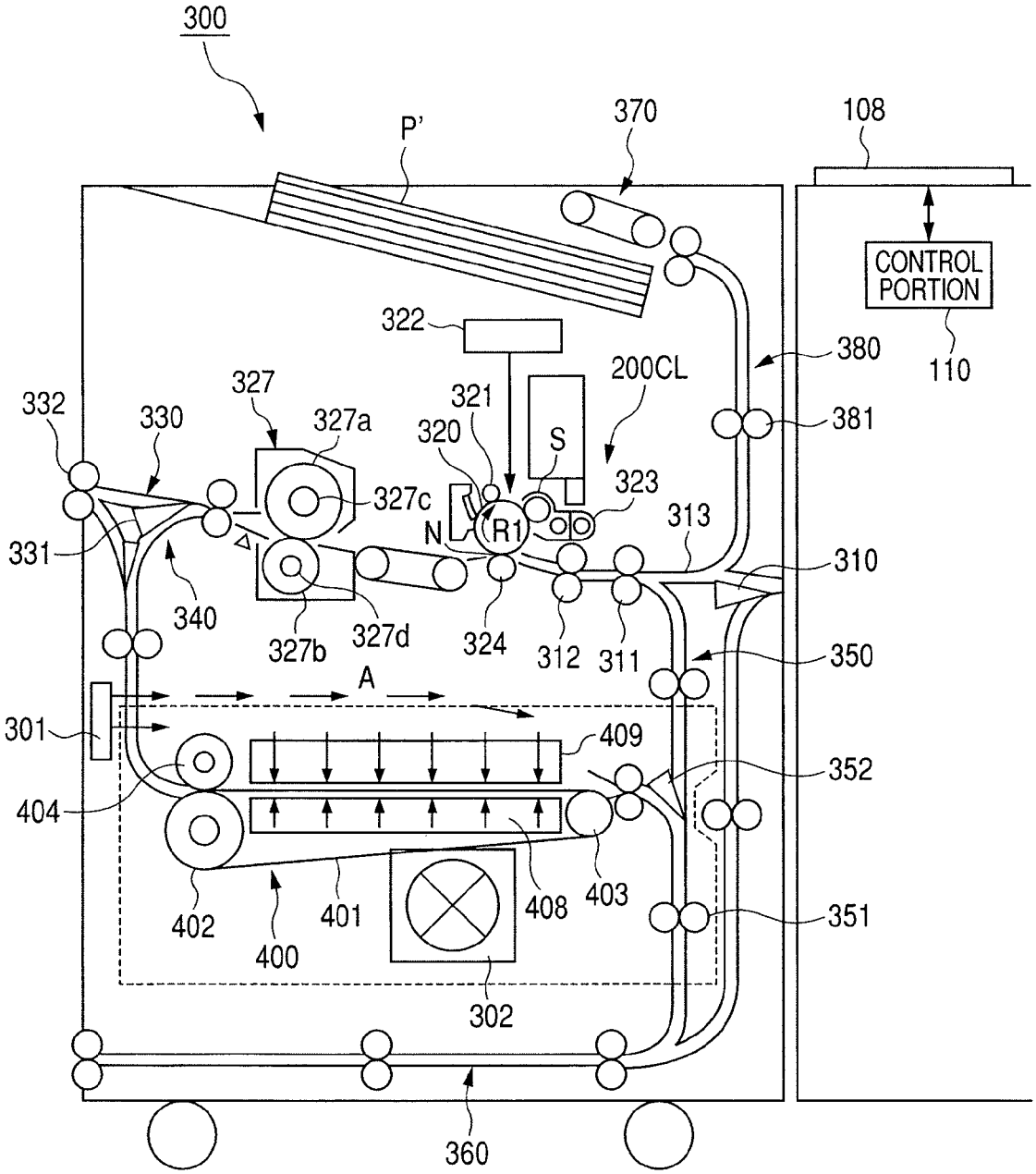
FIG. 3 is an explanatory view illustrating a detailed configuration of a transparent image forming apparatus.

FIG. 1 is an explanatory view of a configuration of an image forming system according to a first embodiment of the present invention, FIG. 2 is an explanatory view of a detailed configuration of a colored image forming apparatus, and FIG. 3 is an explanatory view of a detailed configuration of a transparent image forming apparatus.

As illustrated in FIG. 1, the image forming system according to the first embodiment includes: a colored image forming apparatus 100; a transparent image forming apparatus 300 connected to a later stage outside a housing of the colored image forming apparatus 100; and a post-processing apparatus 600 connected to a later stage outside a housing of the transparent image forming apparatus 300. The colored image forming apparatus 100 is a full-color image forming apparatus. However, the colored image forming apparatus 100 is not limited to a chromatic-color image forming apparatus, and may also be a monochrome image forming apparatus. In the first embodiment, each of the colored image forming apparatus 100, the transparent image forming apparatus 300, and the post-processing apparatus 600 is provided in an independent housing for the sake of convenience in combination of options. However, the three apparatuses may be divided into three housings, into two housings, or provided in a single housing.

The transparent image forming apparatus 300 is separable from the colored image forming apparatus 100 and the post-processing apparatus 600. The transparent image forming apparatus 300 cannot only be used solely but also be used while being connected to the post-processing apparatus 600.

The post-processing apparatus 600 receives recording materials P from the transparent image forming apparatus 300 to temporarily stack the recording materials P in a processing tray 610. In the processing tray 610, a post-process such as an alignment process and a stitching process for the recording materials P is performed. After that, a stack of the recording materials P is discharged in stacks by stack discharging rollers 620 from the processing tray 610 to a stack tray 630.

A direction of conveyance of the recording materials P discharged from a discharging path 360 of the transparent image forming apparatus 300 is switched by a direction switching device 641 toward a processing/conveying path 640 or a discharging path 650.

As illustrated in FIG. 2, the colored image forming apparatus 100 is of four-drum tandem type. Specifically, in the colored image forming apparatus 100, a yellow image forming portion 200Y, a magenta image forming portion 200M, a cyan image forming portion 200C, and a black image forming portion 200K, each exemplified as a colored image forming portion, are arranged along an intermediate transferring belt 125.

In the image forming portion 200Y, a yellow toner image is formed on a photosensitive drum 120Y to be primarily transferred to the intermediate transferring belt 125. In the image forming portion 200M, a magenta toner image is formed on a photosensitive drum 120M to be primarily transferred onto the yellow toner image on the intermediate transferring belt 125 in registration therewith. In a similar manner, a cyan toner image is formed on a photosensitive drum 120C in the image forming portion 200C, whereas a black toner image is formed on a photosensitive drum 120K in the image forming portion 200K. Then, the cyan toner image and black toner images formed as described above are sequentially primarily transferred onto the toner images on the intermediate transferring belt 125 in registration therewith.

The four-color toner images, which have been primarily transferred onto the intermediate transferring belt 125, are secondarily transferred to the recording material P fed to a secondary transferring portion N2 at a time. After the recording materials P, onto which the toner images have been secondarily transferred at the secondary transferring portion N2, are heated in a fixing device 127 to fix the toner images thereon, the recording materials P are discharged to the transparent image forming apparatus (300 denoted in FIG. 1) corresponding to the later stage provided outside the housing of the colored image forming apparatus 100.

A recording material feeding device 101 separates the recording materials P, which are picked up from a recording material cassette 101*a* by pickup rollers 101*b*, one-by-one by a separating device 101*c*, and then, feeds the separated recording material P to a pair of registration rollers 112. The registration rollers 112 receive and hold the recording material P in a stop state to cause the recording material P to wait. Then, the registration rollers 112 send out the recording material P to the secondary transferring portion N2 in timed relation to the toner image on the intermediate transferring belt 125.

Image forming portions 200Y, 200M, 200C, and 200K are configured in almost the same manner except for difference in color of the toners respectively used in developing devices 123Y, 123M, 123C, and 123K respectively provided in the image forming portions 200Y, 200M, 200C, and 200K. Hereinafter, the image forming portion 200Y is described. The description of the image forming portion 200Y is also read as the description of the other image forming portions 200M, 200C, and 200K with the replacement of the suffix alphabet Y of the reference numeral by M, C, or K in the description.

The image forming portion 200Y includes a charging roller 121Y, an exposure device 122Y, a developing device 123Y, a primary transferring roller 124Y, and a cleaning device, which are provided around the photosensitive drum 120Y.

The photosensitive drum 120Y includes: a cylinder made of aluminum; and an organic photoconductive (OPC) layer having a negative charging polarity, which is formed on an outer circumferential surface of the cylinder. The photosensitive drum 120Y rotates in a direction indicated by an arrow R1 at a surface speed substantially equal to that of the intermediate transferring belt 125.

The charging roller 121Y is formed by covering a surface of a central shaft made of a metal with a resistive elastic layer. The charging roller 121Y is in pressure contact with the photosensitive drum 120Y to be driven to rotate in association with the rotation of the photosensitive drum 120Y. A DC voltage obtained by superimposing an AC voltage thereon is applied to the charging roller 121Y from a power source (not shown). As a result, the charging roller 121Y uniformly charges a surface of the photosensitive drum 120Y with a negative potential.

The exposure device 122Y scans a laser beam ON-OFF-modulated based on scan-line image data obtained by expanding a yellow color-separation image, by a rotating mirror to form an electrostatic image on the charged surface of the photosensitive drum 120Y.

The developing device 123Y stirs a two-component developer obtained by mixing a non-magnetic toner into a magnetic carrier to charge the non-magnetic toner to have a negative polarity and the magnetic carrier to have a positive polarity. The charged two-component developer is carried in the form of magnetic brush on a developing sleeve Sa rotating in a direction opposite to that of the photosensitive drum 120Y to rub the photosensitive drum 120Y. A developing voltage obtained by superimposing the AC voltage on the DC voltage having the negative polarity is applied to the developing sleeve Sa. As a result, the toner moves to an exposure portion of the photosensitive drum 120Y having the positive polarity relative to the developing sleeve Sa to perform reversal development of the electrostatic image.

The primary transferring roller 124Y is brought into pressure contact with the photosensitive drum 120Y through an intermediation of the intermediate transferring belt 125 to form a primary transferring portion between the photosensitive drum 120Y and the intermediate transferring belt 125. A DC voltage having the positive polarity is applied to the primary transferring roller 124Y. As a result, the toner image borne on the photosensitive drum 120Y while being charged to have the negative polarity is primarily transferred onto the intermediate transferring belt 125 passing through the primary transferring portion.

The intermediate transferring belt 125 is passed over a driving roller 126*c*, a tension roller 126*d*, and an opposed roller 126*b* to be supported thereby, and is driven by the driving roller 126*c* to rotate in a direction indicated by an arrow R2.

A secondary transferring roller 126*a* is brought into pressure contact with the intermediate transferring belt 125 supported from the inside by the opposed roller 126*b* to form the secondary transferring portion N2 between the secondary transferring roller 126*a* and the intermediate transferring belt 125. The DC voltage having the positive polarity is applied to the secondary transferring roller 126*a*. As a result, the toner image borne on the intermediate transferring belt 125 while being charged to have the negative polarity is secondarily transferred to the recording material P passing through the secondary transferring portion N2.

A belt cleaning device 128 rubs a cleaning web against the intermediate transferring belt 125 to remove a transfer residual toner, paper powder, and the like, which remain on the surface of the intermediate transferring belt 125 passing through the secondary transferring portion N2.

For image formation on both sides of the recording material P, the following control is selected. In the control, the recording material P bearing the surface image fixed thereon is conveyed to a duplex conveying path 140 to re-convey the recording material P to the secondary transferring portion N2, with the front side and the back side thereof being reversed. For the recording material P having the back side on which the image is to be formed, the front side and the back side are reversed so that a trailing edge of the recording material P is changed to a leading edge in a switchback path 143. Then, the recording material P is conveyed to the registration rollers 112 to wait there. The registration rollers 112 send out the recording material P to the secondary transferring portion N2 in timed relation to the toner image borne on the back side of the intermediate transferring belt 125.

The recording material P is conveyed to the secondary transferring portion N2 where the toner image is transferred even onto the opposite side of the recording material P. After the toner image is fixed onto the opposite side of the recording material P by the fixing device 127, the recording material P is discharged to the later stage outside the housing from a discharging/conveying path 130 through discharging rollers 132.

A direction switching device 131 switches the direction of conveyance of the recording material P which has been subjected to the fixing process in the fixing device 127, between to convey the recording material P to the duplex conveying path 140 and to discharge the recording material P from the discharging/conveying path 130 through the discharging rollers 132 to the later stage outside the housing. A direction switching device 142 operates in conjunction with the direction (forward/reverse direction) of conveyance of the recording material P in the switchback path (reversing portion) 143 to perform switchback of the recording material P conveyed to the reversing portion 143, thereby conveying the recording material P to the duplex conveying path 140. The direction switching device 142 performs switching for whether or not to convey the recording material P, which has been subjected to the reversal of the front side and the back side in the reversing portion 143 so that the trailing edge thereof is changed to the leading edge, to the discharging rollers 132 to discharge the recording material P to the later stage outside the housing.

As illustrated in FIG. 3, the recording material P discharged from the colored image forming apparatus 100 is conveyed to registration rollers 312 by conveying rollers 311. After the registration rollers 312 put into a stop state receive the recording material P to correct a skew feeding of the recording material P, the registration rollers 312 start conveying the recording material P in synchronization with the rotation of a photosensitive drum 320 to convey the recording material P to a transferring portion N to place the recording material P exactly on a transparent toner image on the photosensitive drum 320.

An image forming portion 200CL includes a charging roller 321, an exposure device 322, a developing device 323, a transferring roller 324, and a cleaning device, which are provided around the photosensitive drum 320.

The photosensitive drum 320 includes: a cylinder made of aluminum; and an organic photoconductive (OPC) layer having a negative charging polarity, which is formed on an outer circumferential surface of the cylinder. A driving force is transferred to one shaft end of the photosensitive drum 320 to allow the photosensitive drum 320 to rotate in a direction indicated by an arrow R1.

The charging roller 321 is formed by covering a surface of a central shaft made of a metal with a resistive elastic layer. The charging roller 321 is in pressure contact with the photosensitive drum 320 to be driven to rotate in association with the rotation of the photosensitive drum 320. A DC voltage obtained by superimposing an AC voltage thereon is applied to the charging roller 321. As a result, the charging roller 321 uniformly charges a surface of the photosensitive drum 320 with the negative potential.

The exposure device 322 scans a laser beam ON-OFF-modulated based on scan-line image data obtained by expanding a transparent image formed and superimposed on the full color image, by the rotating mirror to form an electrostatic image on the charged surface of the photosensitive drum 320.

The developing device 323 stirs the two-component developer obtained by mixing the non-magnetic toner into the magnetic carrier to charge the non-magnetic toner to have the negative polarity and the magnetic carrier to have the positive polarity. The charged two-component developer is carried in the form of magnetic brush on a developing sleeve S rotating in a direction opposite to that of the photosensitive drum 320 to rub the photosensitive drum 320. The developing voltage obtained by superimposing the AC voltage on the DC voltage having the negative polarity is applied to the developing sleeve S. As a result, the toner moves to an exposure portion of the photosensitive drum 320 having the positive polarity relative to the developing sleeve S to perform the reversal development of the electrostatic image.

The transferring roller 324 is brought into pressure contact with the photosensitive drum 320 to form the transferring portion N with the photosensitive drum 320. The DC voltage having the positive polarity is applied to the transferring roller 324. As a result, the transparent toner image borne on the photosensitive drum 320 while being charged to have the negative polarity is transferred onto the recording material P passing through the transferring portion N.

A fixing device 327 receives the recording material P onto which the transparent toner image has been transferred at the transferring portion N. Then, the fixing device 327 heats the recording material P while nipping and conveying the recording material P, thereby fusing and fixing the unfixed transparent toner image onto the surface of the recording material P. The fixing device 327 includes a fixing roller 327*a* heated by a halogen lamp heater 327*c* and a pressure roller 327*b* heated by a halogen lamp heater 327*d*. The pressure roller 327*b* is brought into pressure contact with the fixing roller 327*a*. A driving force is transmitted from one shaft end of the fixing roller 327*a* to rotate the fixing roller 327*a*, whereas the pressure roller 327*b* is driven to rotate in association with the rotation of the fixing roller 327*a*. Supply power to each of the halogen lamp heaters 327*c* and 327*d* is adjusted to allow each of the fixing roller 327*a* and the pressure roller 327*b* to have a predetermined surface temperature.

A sheet feeding device 370 feeds the recording material P, on which the image is formed by another image forming apparatus, to the registration rollers 312 through a feed path 380. As a result, a glossing process can be performed on the recording material P in the same manner as that performed for the recording material P discharged from the colored image forming apparatus 100.

A direction switching device 331 switches the direction of conveyance of the recording material P, which has been subjected to the fixing process in the fixing device 327, to convey the recording material P to a duplex conveying path 340 or to discharge the recording material P from a discharging/conveying path 330 through discharging rollers 332 to the later stage outside of the housing.

For the formation of the transparent images on both sides of the recording material P, the following control is selected. In the control, the recording material P bearing the transparent image fixed on the front side is conveyed to the duplex conveying path 340 to re-convey the recording material P with the front side and the back side being reversed to the transferring portion N. At this time, a belt fixing device 400 functions as a conveying roller and a conveying belt without heating.

The front side and the back side of the recording material P onto the back side of which the transparent toner image is to be transferred, are reversed in a discharging path 360 exemplified as the switchback path so that the trailing edge of the recording material P is changed to the leading edge. Then, the recording material P is conveyed to the registration rollers 312 to wait there. The registration rollers 312 send out the recording material P to the transferring portion N in timed relation to the transparent toner image for the back side, which is borne on the photosensitive drum 320.

The recording material P is conveyed to the transferring portion N to bear the transparent toner image transferred even onto the back side. After the transparent toner image is fixed by the fixing device 327, the recording material P is discharged to the later stage outside the housing from the discharging/conveying path 330 through the discharging rollers 332.

A direction switching device 352 operates in conjunction with the direction (forward/reverse direction) of conveyance of the recording material P in the discharging path 360 to perform the switchback of the recording material P conveyed to the discharging path 360, thereby sending out the recording material P to a re-conveying path 350.

In the duplex conveying path 340 of the transparent image forming apparatus 300, a glossing portion configured to perform a glossing process for increasing glossiness of the image formed in the image forming portion 200CL is provided to be located below the fixing device 327 and the image forming portion 200CL. The belt fixing device 400 performs the glossing process on the transparent toner image on the recording material P. The recording material P, which has been subjected to the glossing process, is conveyed to the discharging path 360 by conveying rollers 351 to be directly conveyed to the post-processing apparatus (600 denoted in FIG. 1) in the later stage outside the housing.

The discharging path 360 exemplified as a reversing portion is capable of performing switchback of the recording material P to the re-conveying path 350 to convey the recording material P, which has been subjected to the glossing process in the belt fixing device 400, to the post-processing apparatus (600 denoted in FIG. 1) in the later stage outside the housing without re-conveying the recording material P to the transferring portion N.

The sheet feeding device 370 is provided in the transparent image forming apparatus 300. Therefore, a recording material P' on which a colored image is formed by another image forming apparatus can be fed to the feed path 380. The recording material P' is conveyed to the pair of registration rollers 312 by conveying rollers 381 to be processed in the same manner as that of the recording material P discharged from the colored image forming apparatus 100.

(Belt Fixing Device)

Figure 4:
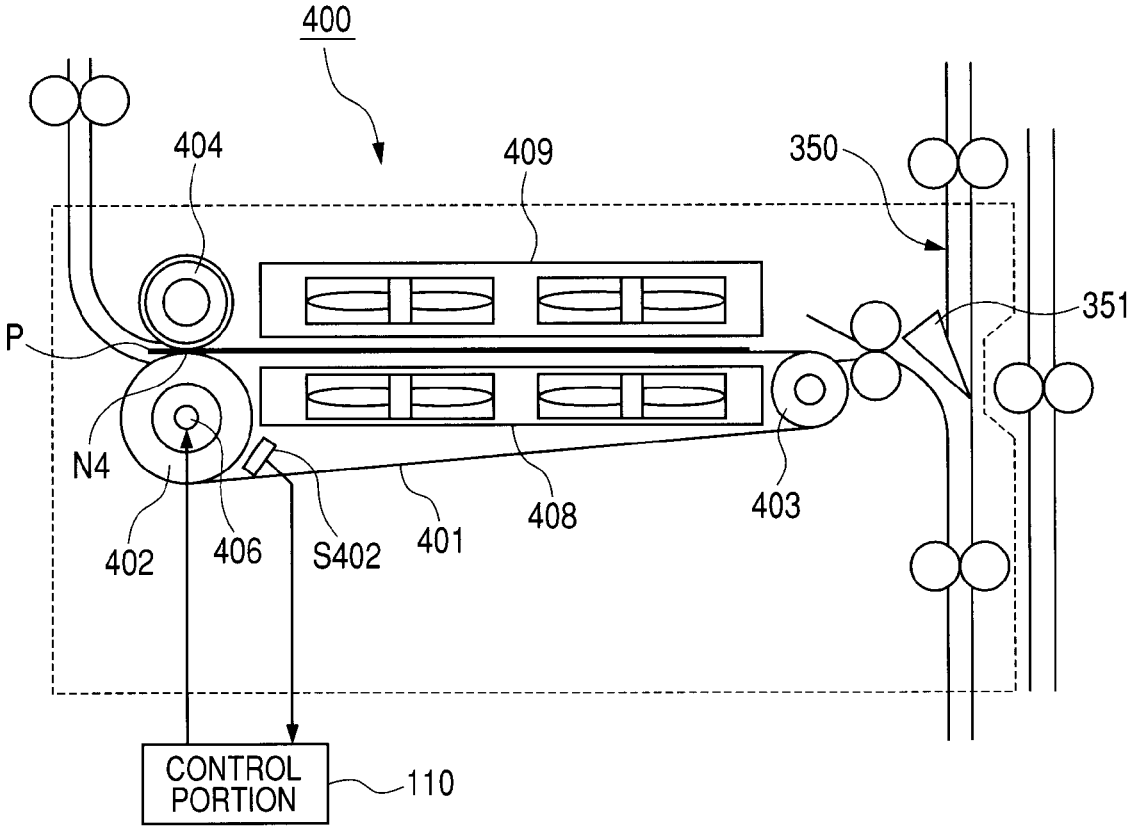
FIG. 4 is an explanatory view illustrating a detailed configuration of a belt fixing device.

FIG. 4 is an explanatory view of a detailed configuration of the belt fixing device 400.

As illustrated in FIG. 4, the belt fixing device 400 allows the recording material P to pass through a heating nip portion N4 integrally with an endless fixing belt 401 while an image surface of the recording material P is in close contact with the endless fixing belt 401. In this manner, the belt fixing device 400 heats a transparent toner image bearing surface of the image surface to re-fuse the transparent toner image. After that, the recording material P is forcibly cooled by cooling fans 408 and 409 while being conveyed by the fixing belt 401, thereby re-solidifying the transparent toner image. As a result, a high glossiness obtained by the transfer of a smooth surface of the fixing belt 401 is given to the image surface of the recording material P, which is covered with the transparent image.

The fixing belt 401 exemplified as a heating member is passed over a heating roller 402 and a separating roller 403 to be supported thereby. A pressure roller 404 exemplified as a pressure member has both axial ends, which are biased by springs, to be brought into pressure contact with the fixing belt 401 supported from the inner side by the heating roller 402. In this manner, the heating nip portion N4 is formed between the fixing belt 401 and the pressure roller 404.

The heating roller 402 is driven from its one end to rotate at a predetermined speed in a clockwise direction in FIG. 4. The fixing belt 401 is driven by the heating roller 402 to rotate at a predetermined speed in the clockwise direction in FIG. 4. The separating roller 403 and the pressure roller 404 are driven to rotate in association with the rotation of the fixing belt 401. The separating roller 403 also serves as a tension roller for applying a predetermined tension to the fixing belt 401.

The heating roller 402 exemplified as a heating member is located to be closer to the fixing device 327. The heating roller 402 has a three-layer structure in a concentric circular fashion. Specifically, the heating roller 402 includes: a core portion constituted by a hollow pipe made of aluminum; an elastic layer made of silicon rubber formed on the outer side of the core portion; and a release layer formed of a fluorine resin material (PFA) covering a surface of the elastic layer.

The pressure roller 404 exemplified as a pressure member also has a three-layer structure in a concentric circular fashion. Specifically, the pressure roller 404 includes: a core portion constituted by a hollow pipe made of aluminum; an elastic layer made of silicon rubber formed on the outer side of the core portion; and a release layer formed of fluorine resin material (PFA) covering a surface of the elastic layer, which is subjected to contact.

The fixing belt 401 has a belt surface to be brought into close contact with the image surface of the recording material P, which is mirrored to have a surface roughness Rz of 1.5 μm or less for the formation of a high-gloss image. The fixing belt 401 includes: a base layer made of a polyimide resin and having a thickness of 85 μm; and an elastic layer made of silicon rubber and having a thickness of 100 μm, which is formed on a surface of the base layer. A release layer made of a polyimide silicon resin and having a thickness of 30 μm is formed as a film on a surface of the elastic layer.

In the hollow pipe of the heating roller 402, a halogen lamp heater 406 serving as a heat source is arranged. The electric power is supplied to the halogen lamp heater 406 to heat the heating roller 402 from inside, thereby increasing a surface temperature of the heating roller 402. The heat source is not limited to the halogen lamp heater 406. A method of performing electromagnetic induction heating on the hollow pipe of the heating roller 402 with a magnetic flux generated from an exciting coil may also be used.

A thermistor S402 detects the surface temperature of the heating roller 402. The surface temperature of the heating roller 402, which is detected by the thermistor S402, is fed back to control of the halogen lamp heater 406.

A control portion 110 also serves as a control portion of a main body of the image forming apparatus 100. The control portion 110 controls the electric power supplied to the halogen lamp heater 406 so as to keep the surface temperature of the heating roller 402 at target temperatures. The control portion 110 regulates and controls the temperature of the heating roller 402 to a predetermined target temperature, thereby controlling a temperature of the heating nip portion N4 to a predetermined fixing temperature (160° C.).

The separating roller 403 includes a hollow pipe made of aluminum, which is provided at a predetermined distance from the heating roller 402.

The cooling fan 408 exemplified as a cooling portion configured to cool the fixing belt 401 is provided to be closer to the image forming portion 200CL while being opposed to an inner surface of the fixing belt 401 downstream of the heating roller 402. The cooling fan 409 for cooling the fixing belt 401 and the recording material P is provided to be opposed to the outer surface of the fixing belt 401 downstream of the heating roller 402.

The cooling fans 408 and 409 provide cooling air to the recording material P and the fixing belt 401 so as to forcibly cool the transparent toner image borne on the recording material P which moves in close contact with the fixing belt 401.

A cooling unit for the recording member P and the fixing belt 401 is not limited to the cooling fans 408 and 409. A Peltier element, a heat pipe, or a circulator of cooling water may also be used.

As illustrated in FIG. 3, the cooling fan 409 sucks outside air from an air suction port 301 provided on a left lateral surface of a main body of the transparent image forming apparatus 300 to create an airflow in a direction indicated by an arrow A in the housing. Cooling air blown toward an upward-facing surface of the fixing belt 401 is exhausted by an exhaust fan 302, which is provided to a rear surface of the main body, to a rearward space of the main body. The position of the air suction port 301 is not limited to the left lateral surface of the main body. The air suction port 301 may be provided at any position as long as the airflow can be generated between the belt fixing device 400 and the image forming portion 200CL.

The belt fixing device 400 receives the recording material P, onto which the transparent toner image is transferred by the image forming portion 200CL and is then fixed by the fixing device 327, and nips and conveys the received recording material P, with the downward-facing image surface being in close contact with the upward-facing surface of the fixing belt 401 by the heating nip portion N4. At this time, a temperature of the transparent toner is increased by heat provided from the heating roller 402 to soften the transparent toner. In addition, a pressure is applied by the pressure roller 404 to the transparent toner image. As a result, the surface of the transparent toner image is brought into close contact with the fixing belt 401. At this time, the image surface of the recording material P, on which the transparent toner image is formed, is flattened to have a mirrored surface after the mirrored surface profile of the fixing belt 401.

The recording material P held in close contact with the fixing belt 401 is efficiently forcibly cooled by the cooling fans 408 and 409 in a cooling area in which the recording material P is conveyed to the separating roller 403 by the rotation of the fixing belt 401. The transparent toner image is cooled to a temperature (about 35° C.) lower than a softening temperature (glass transition temperature: about 50° C.) of the transparent toner. As a result, with the effects of a releasing property of the surface of the fixing belt 401, the transparent toner image becomes easy to separate from the fixing belt 401.

After the transparent toner image is sufficiently cooled in the cooling area to be solidified, the recording material P is separated (self-stripped) from the fixing belt 401 due to its own stiffness in a separating portion where a curvature of the fixing belt 401 changes along the separating roller 403.

The entire image surface of the recording material P separated from the fixing belt 401 after the solidification, which includes an area on which the transparent toner image is fixed and an area on which a colored toner image is fixed, is finished without any concavity and convexity. Such an image surface follows the mirrored surface profile of the fixing belt 401. Therefore, a high-gloss image can be obtained.

The belt fixing device 400 is provided in the duplex conveying path 340 configured to convey the recording material P, with the front side and the back side being reversed to the image forming portion 200CL. The control portion 110 turns OFF the halogen lamp heater 406 so as to stop the power supply to (energization of) the halogen lamp heater 406 at the time of both-side image formation without a high-glossing process. In this manner, the temperature of the heating nip portion N4 of the belt fixing device 400 is set to a temperature at which the transparent toner image on the recording material P is not fused. As a result of the stop of a heating operation of the image, the belt fixing device 400 is used as the conveying path and a part of a conveying mechanism configured to reverse the front side and the back side of the recording material P without the glossing process.

(Control Unit)

Figure 5:
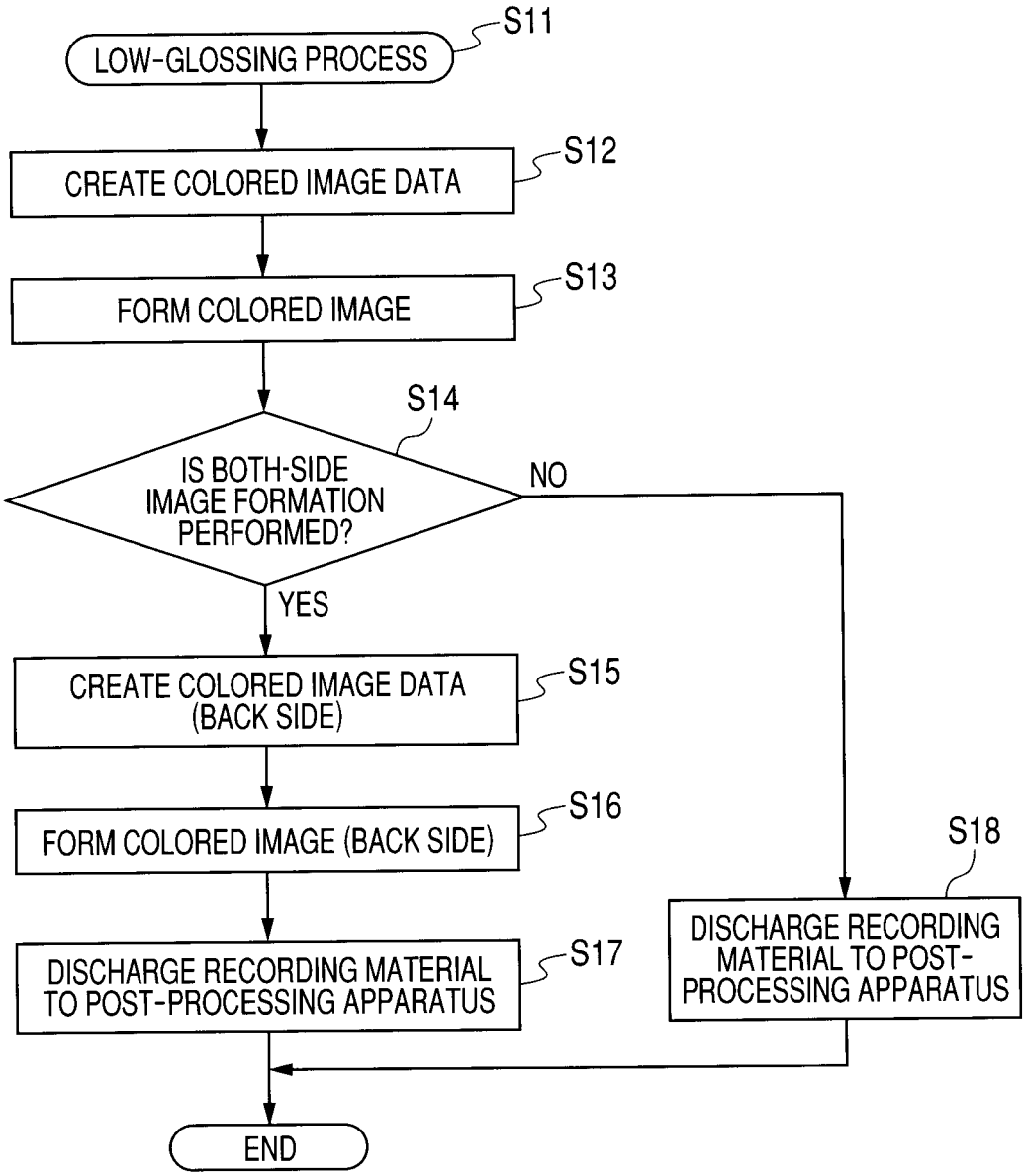
FIG. 5 is a flowchart of a low-glossing process.
Figure 6:
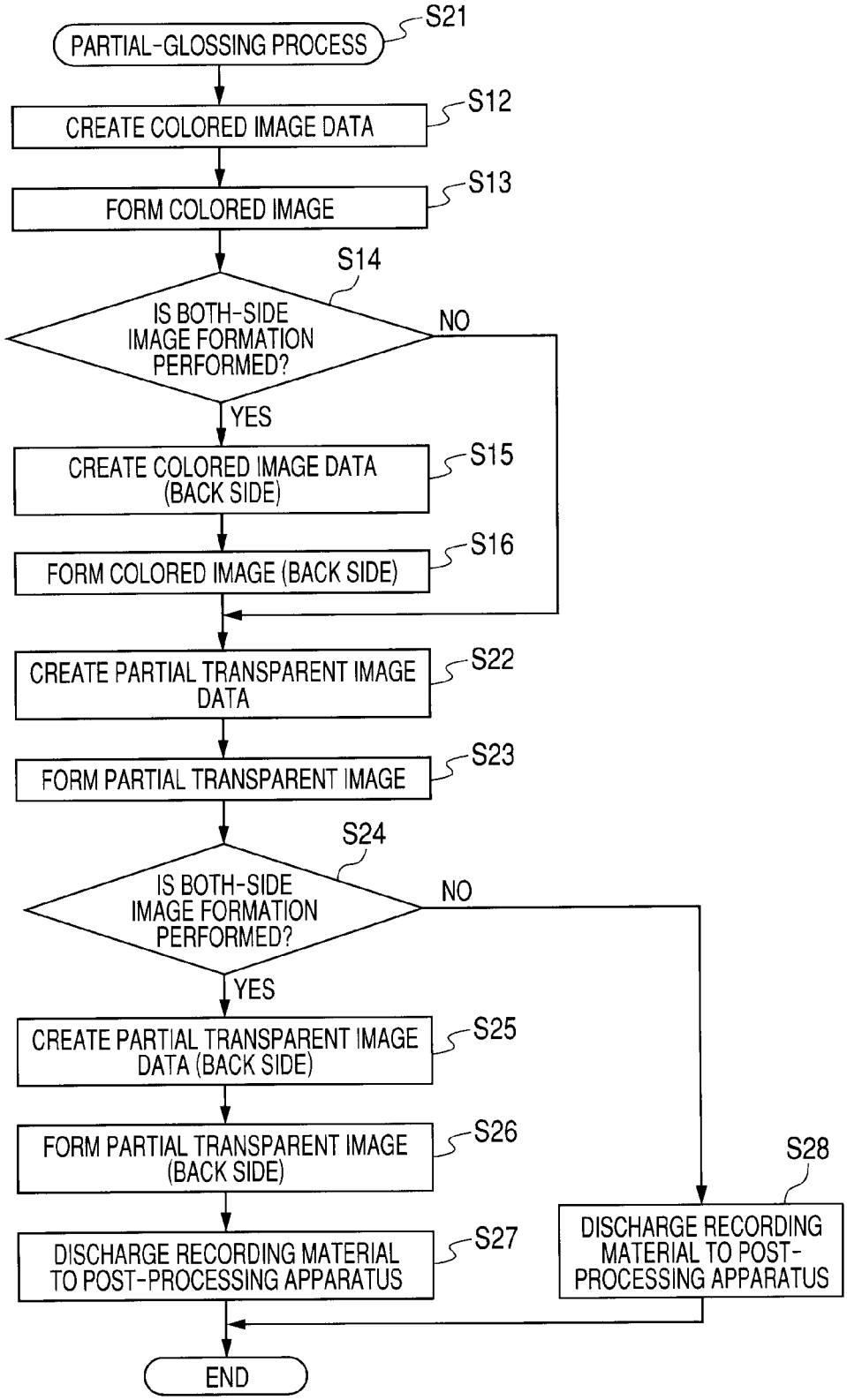
FIG. 6 is a flowchart of a partial-glossing process.
Figure 7:
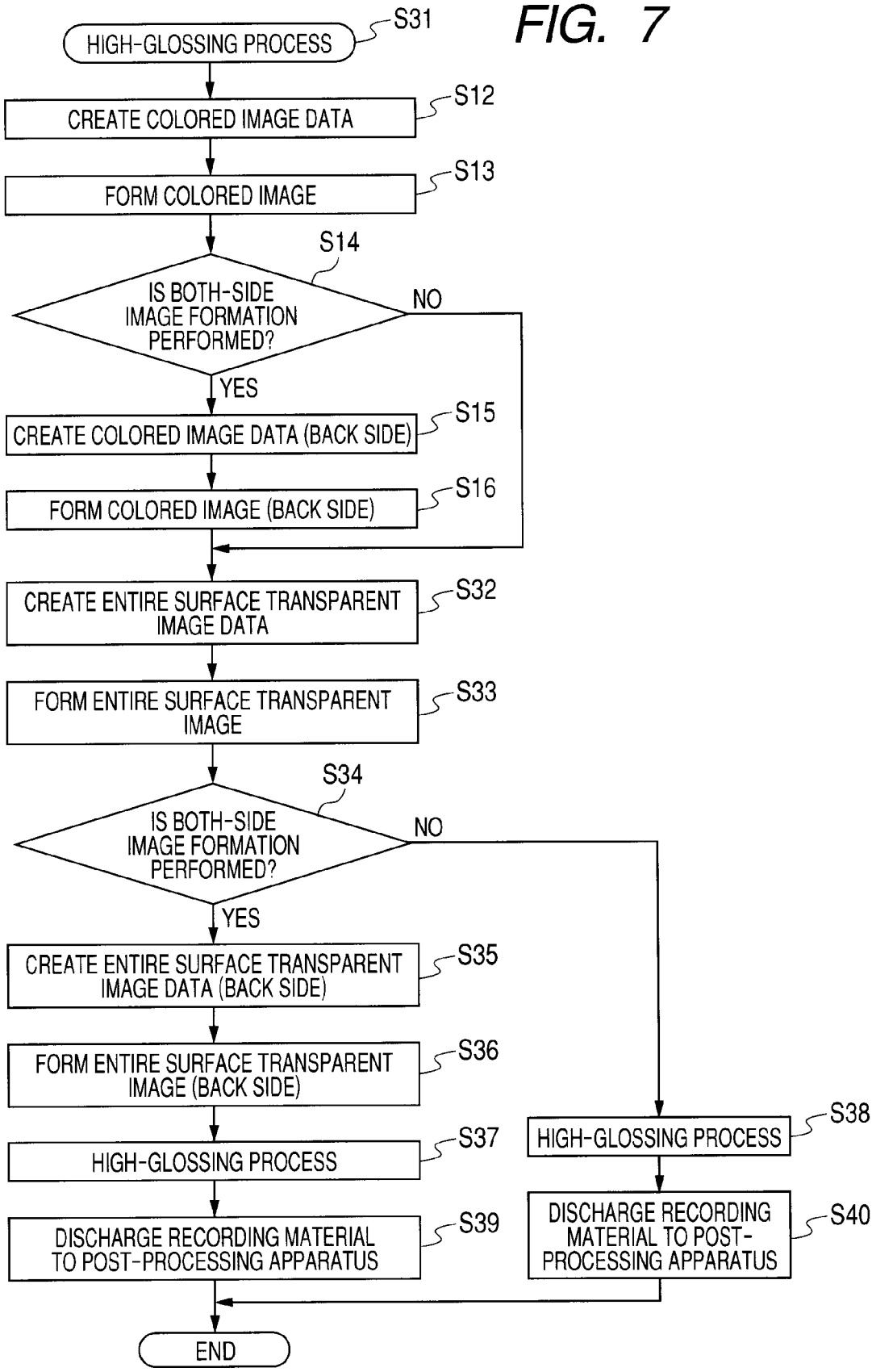
FIG. 7 is a flowchart of a high-glossing process.

FIG. 5 is a flowchart of a low-glossing process, FIG. 6 is a flowchart of a partial-glossing process, and FIG. 7 is a flowchart of the high-glossing process. In FIGS. 5 to 7, control steps common to the processes are denoted by the same reference numeral, and the redundant description thereof is herein omitted.

As illustrated in FIG. 1, the image forming system according to the first embodiment is capable of selecting from among a low-gloss mode, a partial-gloss mode exemplified as a second gloss mode, and a high-gloss mode corresponding to a first gloss mode to execute the selected mode.

(1) Low-gloss mode: In the low-gloss mode, after the colored toner image is fixed onto one side or each side of the recording material P, the recording material P is directly conveyed to the post-processing apparatus 600 without forming the transparent image.

(2) Partial-gloss mode: In the partial-gloss mode, after the colored toner image is fixed onto one side or each side of the recording material P, a transparent character image or pattern image is formed on the image surface of the recording material P to generate a difference in glossiness in a part of the image surface. For example, a glossy pattern is added to a necessary portion of the full-color image to give a three-dimensional appearance or a texture thereto, or glossy characters such as "sample" or "reference" are added.

(3) High-gloss mode: In the high-gloss mode, after the colored toner image is fixed onto one side or each side of the recording material P, the entire image surface is covered with a coating of the transparent image in a mirrored state to give glossiness as excellent as that of sliver halide photography to an output image.

As illustrated in FIG. 5 while referring to FIG. 1, when the low-gloss mode is selected through an operation portion 108 (Step S11), the control portion 110 creates the colored image data from image data (Step S12).

The control portion 110 controls the image forming portions 200Y, 200M, 200C, and 200K to form the colored toner images of the respective colors, transfers the thus formed colored toner images formed as described above to the recording material P, and fixes the transferred colored toner images by the fixing device 127 (Step S13).

In the case of one-side image formation (NO in Step S14), the control portion 110 switches the direction of conveyance of the recording material P toward the discharging/conveying path 130 by the direction switching device 131 and then switches the direction of conveyance of the recording material P toward the discharging path 360 by the direction switching device 310. The recording material P bearing the image formed on one side is conveyed to the discharging path 360 by the discharging rollers 132 to be directly conveyed to the post-processing apparatus 600.

In the case of both-side image formation (YES in Step S14), the control portion 110 switches the direction of conveyance of the recording material P toward the duplex conveying path 140 by the direction switching device 131. The control portion 110 creates the colored image data from back-side image data (Step S15), transfers the colored toner images of the respective colors even to the back side of the recording material P, and fixes the transferred colored toner images by the fixing device 127 (Step S16).

The control portion 110 switches the direction of conveyance of the recording material P toward the discharging/conveying path 130 by the direction switching device 131 and then switches the direction of conveyance of the recording material P toward the discharging path 360 by the direction switching device 310. The recording material P having both the sides on which the images are formed is conveyed by a pair of discharging rollers 132 to the discharging path 360 to be directly conveyed to the post-processing apparatus 600 (Steps S17 and S18).

As illustrated in FIG. 6 while referring to FIG. 1, when the partial-gloss mode is selected through the operation portion 108 (Step S21), the colored toner image is formed on one side or each side of the recording material P in the same procedure (Steps S12 to S16) as that of the low-gloss mode. However, the control portion 110 switches the direction of conveyance of the recording material P toward a conveying path 313 by the direction switching device 310, and hence the recording material P bearing the colored toner image formed as described above is conveyed to the image forming portion 200CL through the conveying path 313.

The control portion 110 creates partial transparent image data from image data of a job (Step S22), controls the image forming portion 200CL to form a toner image of a partial transparent image, transfers the toner image of the partial transparent image to the recording material P, and fixes the transferred toner image by the fixing device 327 (Step S23). The toner image of the partial transparent image is fixed onto the image surface of the recording material P, on which the colored toner image has been fixed, in a superimposing manner.

In the case of one-side image formation (NO in Step S24), the control portion 110 turns off the heating of the belt fixing device 400 to stop the heating operation for the image. In addition, the control portion 110 switches the direction of conveyance of the recording material P toward the discharging/conveying path 330 by the direction switching device 331. The recording material P bearing the partial transparent image fixed on the image surface moves from the direction switching device 331 to the discharging/conveying path 330 so as to be conveyed to the post-processing apparatus 600 by the discharging rollers 332.

In the case of both-side image formation (YES in Step S24), the control portion 110 turns off the heating of the belt fixing device 400 to stop the heating operation for the image. In addition, the control portion 110 switches the direction of conveyance of the recording material P to the duplex conveying path 340 by the direction switching device 331. By turning OFF the halogen lamp heater 406 to stop the heating operation for the image, the belt fixing device 400 is set under a temperature condition in which the toner image on the recording material P is not fused. In this manner, the belt fixing device 400 is controlled to function as the conveying roller and the conveying belt in a surface reverse conveying path.

After the trailing edge of the recording material P passes through the belt fixing device 400 and then through the direction switching device 352, the control portion 110 stops the conveying rollers 351 to switch the direction of conveyance of the recording material P to the re-conveying path 350 by the direction switching device 352. Then, the control portion 110 rotates the conveying rollers 351 in a reverse direction to perform the switchback of the recording material P to feed the recording material P to the re-conveying path 350, thereby re-conveying the recording material P to the image forming portion 200CL. The control portion 110 creates the partial transparent image data from the back-side image data (Step S25), transfers the toner image of the partial transparent image even on the back side of the recording material P, and fixes the toner image of the partial transparent image by the fixing device 327 (Step S26).

The control portion 110 switches the direction of conveyance of the recording material P to the discharging/conveying path 330 by the direction switching device 331. As a result, the recording material P bearing the partial transparent image fixed even onto the back side is conveyed from the discharging/conveying path 330 through the discharging rollers 332 to the post-processing apparatus 600 (Steps S27 and S28).

As illustrated in FIG. 7 while referring to FIG. 1, when the high-gloss mode is selected through the operation portion 108 (Step S31), the colored toner image is formed on one side or each side of the recording material P in the same procedure (Steps S12 to S16) as that of the partial-gloss mode. Moreover, as in the case of the partial-gloss mode, the direction of conveyance of the recording material P is switched toward the conveying path 313 by the direction switching device 310. Therefore, the recording material P, on which the colored toner image is formed, is fed to the image forming portion 200CL through the conveying path 313.

In this high-gloss mode, however, the control portion 110 turns on the heating of the belt fixing device 400 to enable the high-glossing process, and switches the direction of conveyance of the recording material P to the duplex conveying path 340 by the direction switching device 331. After the halogen lamp heater 406 is turned ON, the image formation is on standby until a temperature condition optimal for the high-glossing process to fuse the transparent toner image on the recording material P is achieved.

The control portion 110 creates entire surface transparent image data from the image data of the job (Step S32), controls the image forming portion 200CL to form a toner image of an entire surface transparent image, transfers the toner image of the entire surface transparent image to the recording material P, and fixes the toner image transferred as described above onto the recording material P by the fixing device 327 (Step S33). The toner image of the entire surface transparent image is fixed onto the entire image surface of the recording material P, onto which the colored toner image has been fixed, in a superimposing manner.

The recording material P having the image surface, onto which the toner image of the entire transparent image is fixed, is nipped and conveyed by the heating nip portion N4 of the belt fixing device 400. As a result, the toner image on the recording material P is fused to come into close contact with the fixing belt 401. The recording material P is forcibly cooled while being conveyed in close contact with the fixing belt 401. After that, the recording material P reaches the separating portion of the separating roller 403 to be separated from the fixing belt 401 (Step S37).

In the case of one-side image formation (NO in Step S34), the control portion 110 switches the direction of conveyance of the recording material P toward the discharging path 360 by the direction switching device 352. As a result, the recording material P bearing the entire transparent image formed on one side is conveyed from the belt fixing device 400 to the discharging path 360 so as to be directly conveyed to the post-processing apparatus 600 (Steps S38 and S40).

In the case of both-side image formation (YES in Step S34), after the trailing edge of the recording material P passes through the belt fixing device 400 and then through the direction switching device 352, the conveying rollers 351 are stopped, and the direction of conveyance of the recording material P is switched toward the re-conveying path 350 by the direction switching device 352. Then, the conveying rollers 351 are rotated in a reverse direction to perform the switchback of the recording material P to convey the recording material P to the re-conveying path 350, thereby re-conveying the recording material P to the image forming portion 200CL. The control portion 110 creates the entire surface transparent image data from the back-side image data (Step S35), transfers the toner image of the entire surface transparent image even to the back side of the recording material P, and fixes the transferred toner image by the fixing device 327 (Step S36). The recording material P is then discharged and conveyed to the post-processing apparatus (Step S39).

As described above, in the embodiments according to the present invention, the duplex conveying path 340 for forming the entire surface transparent images on both sides of the recording material P is provided below the image forming portion 200CL, and the belt fixing device 400 for the high-glossing process is provided in the duplex conveying path 340. As a result, a horizontal length of the main body of the transparent image forming apparatus 300 capable of carrying out the high-gloss mode, the low-gloss mode, and the partial-gloss mode for both the front side and the back side of the recording material P can be reduced to achieve reduction in installation area for the entire image forming system. Specifically, while the automatic both-side image formation for both the high-gloss image and the low-gloss image is realized, the installation area for the transparent image forming apparatus 300 can be reduced.

More specifically, the switchback of the recording material P is performed to reverse the front side and the back side of the recording material P after the recording material P is moved to the image forming portion 200CL to pass through the belt fixing device 400. Therefore, in the belt fixing device 400, the recording material P is conveyed with the image surface thereof facing downward.

On the other hand, if the front side and the back side of the recording material P are reversed before the recording material P is moved to the image forming portion as in the case of the conventional general configuration (see FIG. 2), the recording material P is conveyed, with the image surface thereof facing upward in the belt fixing device 400. Therefore, a phenomenon cannot be prevented where the recording material P is separated from the fixing belt 401 by gravity during cooling to generate a faulty image.

Moreover, the belt fixing device 400 includes the cooling fans 408 and 409 provided between the belt fixing device 400 whose temperature rises and the image forming portion 200CL which is sensitive to a change in temperature, thereby generating the airflow in the direction indicated by the arrow A, in which change in temperature is reduced. Therefore, thermal insulation properties between the belt fixing device 400 and the image forming portion 200CL are enhanced. As a result, the temperature of the image forming portion 200CL is hardly increased by the heat generated in the belt fixing device 400, and hence the transparent toner can be prevented from being deteriorated by the heat.

Further, the heating roller 402 which corresponds to a principal heat generating portion of the belt fixing device 400 is provided below the fixing device 327. The place below the fixing device 327 is unlikely to be thermally affected by the fixing device 327. The cooling area of low temperature, which is realized by the cooling fans 408 and 409, is provided below the image forming portion 200CL which is susceptible to the thermal affection. Therefore, the effects on the image forming portion 200CL by the heat generated from the belt fixing device 400 are further reduced. As a result, the positional arrangement between the transparent image forming portion, the fixing device 327, and the belt fixing device 400 is optimal in terms of the thermal effects. Therefore, the transparent image forming portion, the fixing device 327, and the belt fixing device 400 can be contained within a downsized housing provided with a little heat-shielding structure inside of the housing, thereby reducing the size of the transparent image forming apparatus 300.

The transparent image forming apparatus 300 includes the discharging/conveying path 330 configured to discharge the recording material P to the outside of the transparent image forming apparatus 300 after the toner image is fixed by the fixing device 327 alone and the discharging path 360 configured to discharge the recording material P to the later stage outside the housing after the fixing and the high-glossing process are performed by the fixing device 327 and the belt fixing device 400. Therefore, the recording material P, which has been subjected to the high-glossing process by the belt fixing device 400, can be conveyed to the post-processing apparatus 600 without being re-conveyed to the image forming portion 200CL.

Further, the transparent image forming apparatus 300 includes the conveying path (360 denoted in FIG. 1) configured to convey the recording material P discharged from the colored image forming apparatus 100 to the post-processing apparatus 600 without re-conveying the recording material P to the image forming portion 200CL. Therefore, even when the transparent image forming apparatus 300 is provided, the image formed by using the colored image forming apparatus 100 alone can be output. As a result, the both-side image formation with various glossiness can be selected by a single operation performed through the operation portion 108 to be automatically executed.

The transparent image forming apparatus 300 is capable of forming the transparent images on both sides of the recording material P. Therefore, for the formation of the transparent images on both sides, it is not necessary to manually reload a sheet, which is discharged to the outside of the transparent image forming apparatus 300 after the formation of the transparent image on the front side, to the transparent image forming apparatus 300.

Further, the colored image forming apparatus 100 and the transparent image forming apparatus 300 are divided into the different separable housings, respectively, and hence the transparent image forming apparatus 300 can be used while being connected to the image forming apparatus other than the colored image forming apparatus 100. Moreover, the transparent image forming apparatus 300 alone can be used as a high-glossing process apparatus.

The transparent image forming apparatus 300 is constituted as a separable independent apparatus. As a result, the high-glossing process using the transparent image can be realized in various image forming systems.

(Attachment/detachment Structure)

Figure 8:
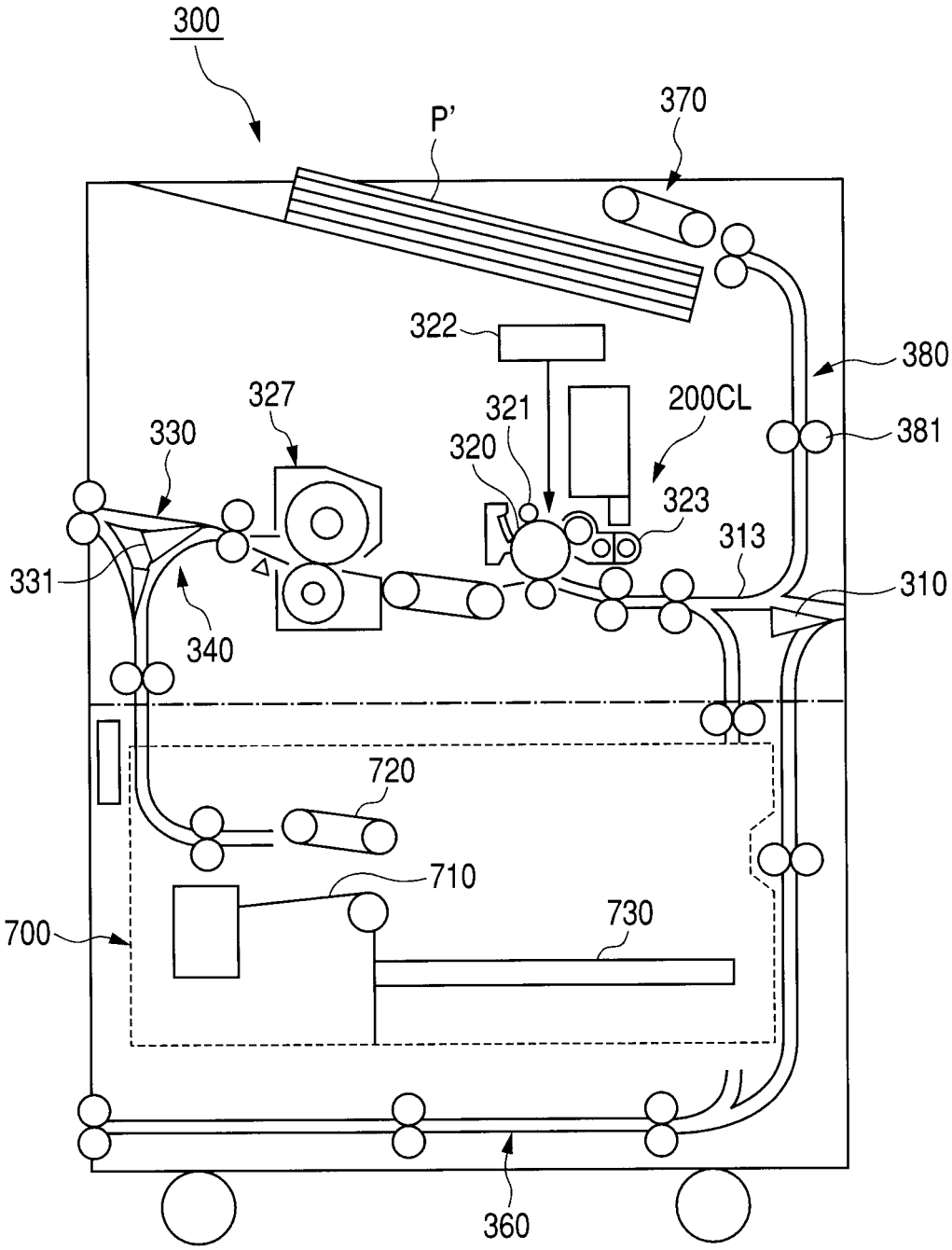
FIG. 8 is an explanatory view of an attachment/detachment structure of a belt fixing device.

FIG. 8 is an explanatory view of an attachment/detachment structure of the belt fixing device.

As illustrated in FIG. 3, the belt fixing device 400 of the transparent image forming apparatus 300 is adapted to be attachable/detachable with respect to a portion indicated by a broken line. In a space obtained by detaching the belt fixing device 400, a post-processing apparatus 700 can be mounted as illustrated in FIG. 8.

The post-processing apparatus 700 receives the recording material P to temporarily stack the recording material P in a processing tray 710 where the recording material P is subjected to a post-process such as an alignment process and a stitching process. After that, the stack of the recording materials P is discharged from the processing tray 710 to a stack tray 730 by stack discharging rollers 720.

Although, as illustrated in FIG. 3, the belt fixing device 400 is detachably mounted to the portion indicated by the broken line in the first embodiment, the housing may be divided into an upper portion and a lower portion as indicated by an alternate long and short dash line in FIG. 8. In this case, a portion for housing the image forming portion 200CL is placed on top of a portion for housing the post-processing apparatus 700 to be connected thereto. With this structure, the portion for housing the post-processing apparatus 700 can be replaced by the portion for housing the belt fixing device (400 denoted in FIG. 3).

In the first embodiment, the belt fixing device 400 for the high-glossing process is detachably mounted to the transparent image forming apparatus 300. The post-processing apparatus 700 can be mounted in the space obtained by detaching the belt-fixing device 400 for the high-glossing process. Therefore, various apparatus configurations can be provided depending on the needs of a user.

(Second Embodiment)

Figure 9:
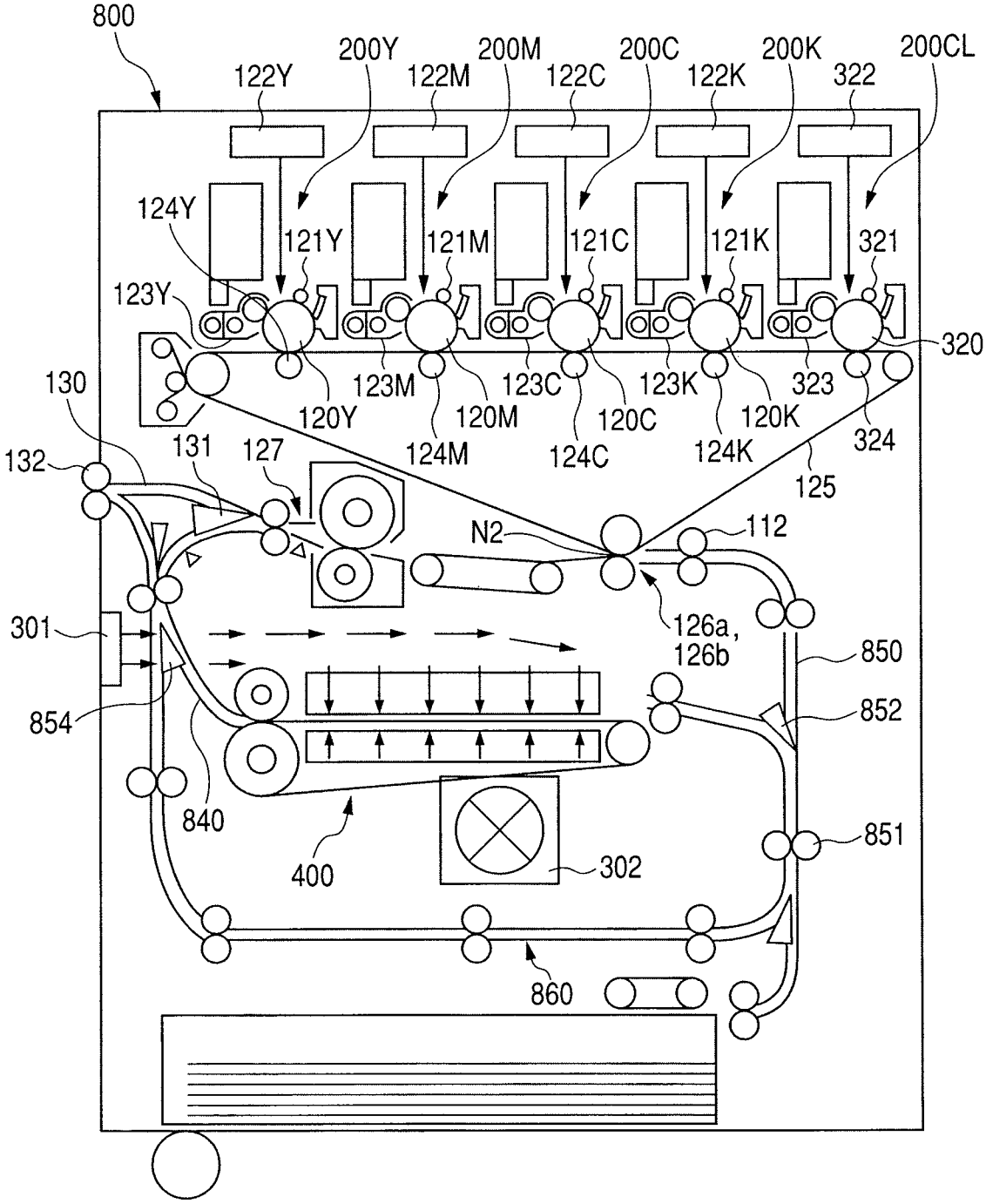
FIG. 9 is an explanatory view of a configuration of an image forming apparatus according to a second embodiment of the present invention.

FIG. 9 is an explanatory view of a configuration of an image forming apparatus according to a second embodiment of the present invention. An image forming apparatus 800 according to the second embodiment includes the image forming portion 200CL illustrated in FIG. 3 incorporated into the housing of the colored image forming apparatus 100 illustrated in FIG. 2. Therefore, the components common to the image forming system according to the first embodiment are denoted in FIG. 9 by the same reference symbols as those of FIGS. 2 and 3, and the redundant description thereof is herein omitted.

As illustrated in FIG. 9, the image forming apparatus 800 is of five-drum tandem type. Specifically, the image forming apparatus 800 includes the yellow image forming portion 200Y, the magenta image forming portion 200M, the cyan image forming portion 200C, the black image forming portion 200K, and the transparent image forming portion 200CL, which are arranged along the intermediate transferring belt 125.

In the image forming portion 200Y, the yellow toner image is formed on the photosensitive drum 120Y to be primarily transferred to the intermediate transferring belt 125. In the image forming portion 200M, the magenta toner image is formed on the photosensitive drum 120M to be primarily transferred onto the yellow toner image on the intermediate transferring belt 125 in alignment with the yellow toner image. In the image forming portions 200C and 200K, the cyan toner image is formed on the photosensitive drum 120C, and the black toner image is formed on the photosensitive drum 120K. The cyan toner image and black toner image formed as described above are sequentially primarily transferred onto the toner images on the intermediate transferring belt 125 in alignment therewith in the same manner.

In the image forming portion 200CL, the transparent toner image is formed on the photosensitive drum 320 and is then primarily transferred to the toner images on the intermediate transferring belt 125 in alignment therewith.

The five-color toner images, which have been primarily transferred onto the intermediate transferring belt 125 in alignment (in register), are secondarily transferred onto the recording material P conveyed to the secondary transferring portion N2 at a time. The recording material P, onto which the toner images are secondarily transferred at the secondary transferring portion N2, can be conveyed to the belt fixing device 400 to be subjected to the high-glossing process after the toner images are fixed by the fixing device 127.

In the case of one-side image formation in the partial-gloss mode, the direction switching device 131 switches the direction of conveyance of the recording material P toward the discharging/conveying path 130. After the colored toner image and the partial transparent toner image formed on the recording material P are fixed by the fixing device 127, the recording material P moves from the direction switching device 131 to the discharging/conveying path 130 so as to be conveyed to the later stage outside the housing by the discharging rollers 132.

In the case of both-side image formation in the partial-gloss mode, the direction switching device 131 switches the direction of conveyance of the recording material P toward a duplex conveying path 840. Moreover, the belt fixing device 400 turns OFF the halogen lamp heater 406 to stop the heating operation for the image. In this manner, the belt fixing device 400 is controlled to function as the conveying roller and the conveying belt under the temperature condition where the toner images on the recording material P is not fused.

After the trailing edge of the recording material P passes through the belt fixing device 400 and then through a direction switching device 852, conveying rollers 851 are stopped and the direction of conveyance of the recording material P is switched toward a re-conveying path 850 by the direction switching device 852. Then, the conveying rollers 851 are rotated in a reverse direction to perform the switchback of the recording material P to convey the recording material P to the re-conveying path 850. In this manner, the recording material P is re-conveyed to the secondary transferring portion N2.

After the colored toner image and the partial transparent toner image secondarily transferred even onto the back side of the recording material P are fixed by the fixing device 127, the recording material P moves from the direction switching device 131 to the discharging/conveying path 130 to be conveyed to the later stage outside the housing by the discharging rollers 132.

In the case of one-side image formation in the high-gloss mode, the heating of the belt fixing device 400 is turned on to enable the high-glossing process. In addition, the direction of conveyance of the recording material P is switched to the duplex conveying path 840 by the direction switching device 131.

After the colored toner images and the entire surface transparent toner images, which have been secondarily transferred to the recording material P, are fixed by the fixing device 127, the recording material P is conveyed to the belt fixing device 400 to be subjected to the high-glossing process. The recording material P, which has been subjected to the high-glossing process, is conveyed from the direction switching device 852 to a discharging path 860. Then, the recording material P passes through a direction switching device 854 to be conveyed to the later stage outside the housing by the discharging rollers 132.

In the case of both-side image formation in the high-gloss mode, after the trailing edge of the recording material P which has been subjected to the high-glossing process passes through the belt fixing device 400 and then through the direction switching device 852, the conveying rollers 851 are stopped and the direction of conveyance of the recording material P is switched toward the re-conveying path 850 by the direction switching device 852. Then, the conveying rollers 851 are rotated in a reverse direction to perform the switchback of the recording material P to convey the recording material P to the re-conveying path 850. In this manner, the recording material P is re-conveyed to the secondary transferring portion N2.

After the colored toner image and the entire surface transparent toner image, which have been secondarily transferred even to the back side of the recording material P, are fixed by the fixing device 127, the recording material P is conveyed to the belt fixing device 400 to be subjected to the high-glossing process. After that, the recording material P moves from the direction switching device 852 to the discharging path 860, with both the front side and the back side thereof being subjected to the high-glossing process. Then, the recording material P passes through the direction switching device 854 to be conveyed to the later stage outside the housing by the discharging rollers 132.

(Third Embodiment)

Figure 10:
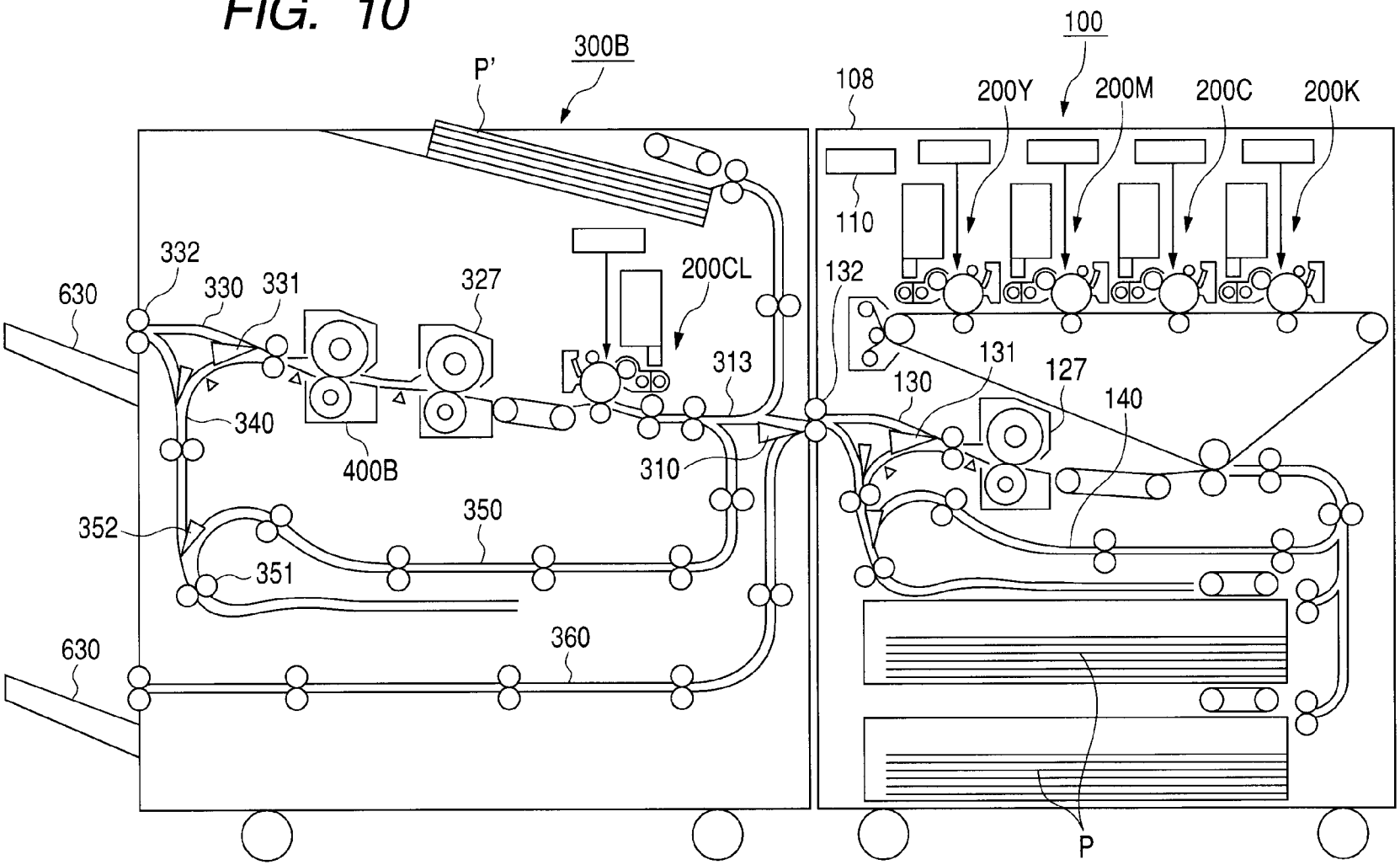
FIG. 10 is an explanatory view of a configuration of an image forming system according to a third embodiment of the present invention.
Figure 11:
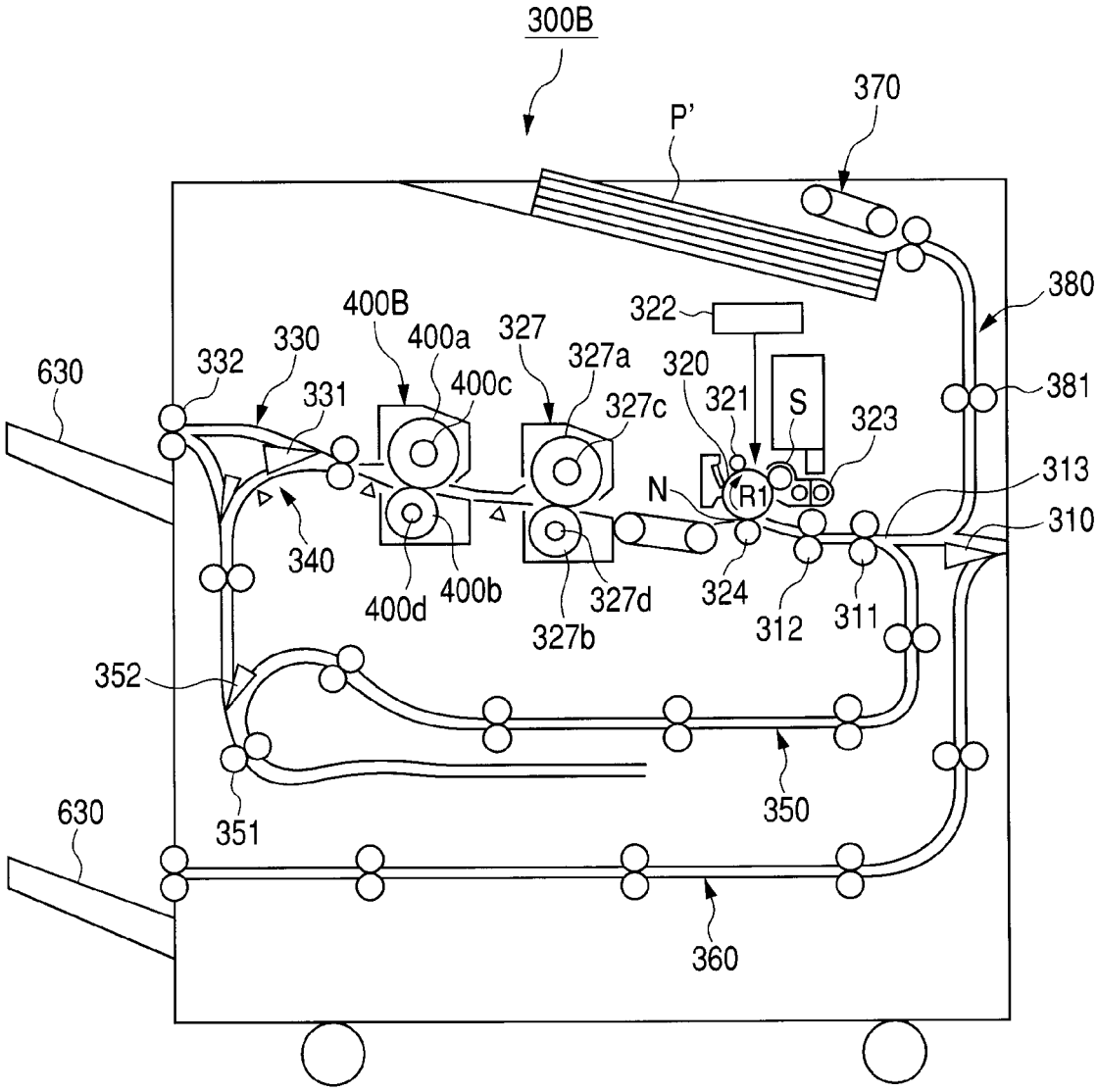
FIG. 11 is an explanatory view of a detailed configuration of a transparent image forming apparatus according to the third embodiment.

FIG. 10 is an explanatory view of a configuration of a image forming system according to a third embodiment of the present invention, and FIG. 11 is an explanatory view of a detailed configuration of a transparent image forming apparatus according to the third embodiment.

As illustrated in FIG. 10, a transparent image forming apparatus 300B is configured almost in the same manner as that of the first embodiment illustrated in FIG. 1 except that a glossing portion (400B) is a roller fixing device which is located at almost the same height as that of the fixing device 327 at the downstream of the fixing device 327. Therefore, in FIGS. 10 and 11, the components common to the first embodiment are denoted by the same reference symbols as those of FIGS. 1 and 3, and the redundant description thereof is herein omitted.

As illustrated in FIG. 11, the fixing device 400B includes a fixing roller 400*a* heated by a halogen lamp heater 400*c* and a pressure roller 400*b* heated by a halogen lamp heater 400*d*. The pressure roller 400*b* is brought into pressure contact with the fixing roller 400*a*. A driving force is transmitted from one shaft end of the fixing roller 400*a* to rotate the fixing roller 400*a*. The pressure roller 400*b* is driven to rotate in association with the rotation of the fixing roller 400*a*. The supply power to each of the halogen lamp heaters 400*c* and 400*d* is adjusted so that a surface temperature of each of the fixing roller 400*a* and the pressure roller 400*b* reaches a predetermined temperature.

As illustrated in FIG. 10, the image forming system according to the third embodiment can also be executed by selecting from among the low-gloss mode, the partial-gloss mode exemplified as the second gloss mode, and the high-gloss mode exemplified as the first gloss mode.

In the low-gloss mode, the recording material P bearing the colored image transferred and fixed by the colored image forming apparatus 100 is discharged to the stack tray 630 without being subjected to the glossing process in the transparent image forming apparatus 300B. The direction of conveyance of the recording material P is switched toward the discharging path 360 by the direction switching device 310 to cause the recording material P to be conveyed to the discharging path 360. As a result, the recording material P passes through the transparent image forming apparatus 300B without being processed therein.

In the partial-gloss mode, the fixing device 400B turns OFF the halogen lamp heaters 400*c* and 400*d* to stop the heating operation for the image to be set under a temperature condition where the toner image on the recording material P is not fused. In this manner, the fixing device 400B functions as the conveying roller in the surface reverse conveying path. The recording material P, on which the colored image is formed, is conveyed from the direction switching device 310 through the conveying path 313 to the image forming portion 200CL. The toner image of the partial transparent image is transferred to the recording material P in the image forming portion 200CL, and is then fixed by the fixing device 327. In this manner, the toner image of the partial transparent image is fixed onto the image surface of the recording material P, onto which the colored toner image has been fixed, in a superimposing manner.

In the case of one-side image formation, the recording material P, onto which the partial transparent image is fixed, moves from the direction switching device 331 to the discharging/conveying path 330 to be discharged to the stack tray 630 by the discharging rollers 332.

In the case of both-side image formation, the control portion 110 switches the direction of conveyance of the recording material P toward the duplex conveying path 340 by the direction switching device 331. After the trailing edge of the recording material P passes through the duplex conveying path 340 then through the direction switching device 352, the conveying rollers 351 are stopped by the control portion 110 to switch again the direction of conveyance of the recording material P toward the re-conveying path 350 by the direction switching device 352. Then, the conveying rollers 351 are rotated in a reverse direction to perform the switchback of the recording material P to convey the recording material P to the re-conveying path 350. In this manner, the recording material P is re-conveyed to the image forming portion 200CL where the toner image of the partial transparent image is transferred even onto the back side surface of the recording material P. After that, the toner image of the partial transparent image is fixed by the fixing device 327.

The control portion 110 switches the direction of conveyance of the recording material P toward the discharging/conveying path 330 by the direction switching device 331. As a result, the recording material P bearing the partial transparent image fixed even onto the back side is discharged from the discharging/conveying path 330 through the discharging rollers 332 to the stack tray 630.

In the high-gloss mode, the image surface of the recording material P, which is heated and pressurized by the fixing device 327, is additionally heated and pressurized by the fixing device 400B to give one-step higher glossiness to the image surface. The recording material P bearing the colored image formed in the colored image forming apparatus 100 is conveyed from the direction switching device 310 through the conveying path 313 to the image forming portion 200CL as in the case of the partial-gloss mode.

The control portion 110 turns off the heating of the fixing device 400B and places the image formation in a standby state until a temperature condition optimal for the high-glossing process for the transparent toner image is satisfied. In this manner, the high-glossing process by the fixing device 400B is enabled.

The control portion 110 controls the image forming portion 200CL to form the toner image of the entire surface transparent image, transfers the toner image of the entire surface transparent image onto the entire image surface of the recording material P onto which the colored toner image has been fixed, and fixes the transferred toner image by the fixing device 327. The recording material P, onto which the toner image of the entire surface transparent image is fixed, is nipped and conveyed by a heating nip of the fixing device 400B. As a result, the image surface of the recording material P is subjected to the high-glossing process.

In the case of one-side image formation, the control portion 110 switches the direction of conveyance of the recording material P toward the discharging/conveying path 330 by the direction switching device 331. As a result, the recording material P bearing the entire surface transparent image formed on one side is conveyed from the fixing device 400B to the discharging/conveying path 330 to be directly discharged to the stack tray 630.

In the case of both-side image formation, the control portion 110 switches the direction of conveyance of the recording material P toward the duplex conveying path 340 by the direction switching device 331. After the trailing edge of the recording material P passes through the duplex conveying path 340 and then through the direction switching device 352, the conveying rollers 351 are stopped to switch again the direction of conveyance of the recording material P toward the re-conveying path 350 by the direction switching device 352. Then, the conveying rollers 351 are rotated in a reverse direction to perform the switchback of the recording material P to convey the recording material P to the re-conveying path 350. In this manner, the recording material P is re-conveyed to the image forming portion 200CL where the toner image of the entire surface transparent image is transferred even onto the back side surface of the recording material P. After that, the entire surface transparent image on the back side of the recording material P is fixed and is subjected to the high-glossing process in two steps by the fixing devices 327 and 400B.

The recording material P bearing the toner image of the entire surface transparent image, which is fixed and subjected to the high-glossing process even on the back side, is conveyed from the direction switching device 331 to the discharging/conveying path 330 to be directly discharged to the stack tray 630.

The transparent image forming apparatus 300B includes the fixing device 400B which is provided in the re-conveying path configured to re-convey the recording material P bearing the transparent image which is transferred by the image forming portion 200CL and is fixed by the fixing device 327 to the image forming portion 200CL. Therefore, it is unnecessary to provide a conveying path configured to convey the recording material P bearing the transparent image fixed by the fixing device 327 to the discharging/conveying path 330 without causing the recording material P to pass through the fixing device 400B.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-202572, filed Aug. 6, 2008, which is hereby incorporated by reference herein in its entirety.

What is claimed is:

1. An image forming apparatus, comprising:

an image forming portion configured to form a toner image on a recording material and heat-fix the toner image onto the recording material;

a re-conveying path configured to re-convey the recording material having a front side, on which the toner image has been formed and heat-fixed by the image forming portion, to the image forming portion so that a toner image is formed and heat-fixed on a back side of the recording material;

a glossing portion configured to perform a glossing process for increasing glossiness of the toner image formed and heat-fixed by the image forming portion; and an executing device configured to execute:

a first gloss mode in which the glossing portion performs the glossing process on the toner image of the recording material re-conveyed, after the toner image is formed and heat-fixed on the front side of the recording material, through the re-conveying path to the image forming portion so as to form a high-gloss toner image; and a second gloss mode in which the image forming portion forms, without re-conveying a recording material to the re-conveying path, a toner image on the recording material so that a glossiness of the toner image formed in the second gloss mode is lower than a glossiness of a toner image formed in the first gloss mode, wherein the glossing portion is provided in the re-conveying path.

2. An image forming apparatus according to claim 1, wherein the glossing portion comprises:

a heating member configured to heat the toner image on the recording material at a nip portion; and a pressure member brought into contact with the heating member to form the nip portion, wherein a heating operation at the nip portion is stopped in the second gloss mode.

3. An image forming apparatus according to claim 2, wherein the glossing portion comprises a cooling portion configured to cool the toner image on the recording material before the recording material heated at the nip portion is separated from the heating member.

4. An image forming apparatus according to claim 3, further comprising a discharging path configured to discharge the recording material bearing the toner image formed and heat-fixed by the image forming portion to an outside of a housing without causing the recording material to pass through the re-conveying path.

5. An image forming apparatus according to claim 4, wherein the re-conveying path comprises a reversing portion configured to perform switchback for reversing the front side and the back side of the recording material, and the reversing portion is provided downstream of the glossing portion in a direction of conveyance of the recording material.

6. An image forming apparatus according to claim 5, wherein the image forming portion forms a transparent toner image.

7. An image forming apparatus according to claim 5, wherein the image forming portion forms a transparent toner image and a plurality of color toner images.

* * * * *